United States Patent [19]

Lee

[11] 4,050,834

[45] Sept. 27, 1977

[54] INTERNALLY POWERED TRAFFIC CONTROL DEVICE

[75] Inventor: John H. Lee, Woodbury, Minn.

[73] Assignee: Minnesota Mining and Manufacturing Company, St. Paul, Minn.

[21] Appl. No.: 655,091

[22] Filed: Feb. 4, 1976

[51] Int. Cl.[2] ..... E01F 11/00; E01F 9/08

[52] U.S. Cl. ..... 404/16; 350/97; 362/145

[58] Field of Search ..... 404/15, 14, 13, 16, 404/9, 10; 350/97; 116/63 R; 357/72, 73, 17; 240/10 R, 10 T, 2 R, 10.6 CH, 10.6 SD, 10.5

[56] References Cited

U.S. PATENT DOCUMENTS

| | | | |
|---|---|---|---|
| 3,164,071 | 1/1965 | Rubenstein | 404/10 |
| 3,737,647 | 6/1973 | Gomi | 357/17 X |
| 3,836,275 | 9/1974 | Finch | 404/13 |
| 3,873,880 | 3/1975 | Riddell | 240/10 T X |
| 3,879,148 | 4/1975 | Eigenmann | 404/14 X |
| 3,894,225 | 7/1975 | Chao | 240/10 R X |
| 3,920,346 | 11/1975 | Wyckoff | 404/14 |

FOREIGN PATENT DOCUMENTS

| | | | |
|---|---|---|---|
| 2,417,584 | 10/1974 | Germany | 404/14 |

*Primary Examiner*—Nile C. Byers
*Attorney, Agent, or Firm*—Cruzan Alexander; Donald M. Sell; William B. Barte

[57] ABSTRACT

A traffic control device in which a solid state light source such as a light emitting diode (LED) is energized by a power supply such as a battery pack contained within the device. The battery life and conspicuousness of the device are enhanced by providing a network which includes an oscillator circuit and a photocell for intermittently energizing the LED only when the intensity of the ambient light is below a predetermined level. In a preferred embodiment, a plurality of LED's are sequentially energized to enable directional control.

14 Claims, 7 Drawing Figures

INTERNALLY POWERED TRAFFIC CONTROL DEVICE

BACKGROUND OF THE INVENTION

1. Field of the Invention

This invention relates to roadway marking devices, particularly to such devices having internal light sources.

2. Description of the Prior Art

The need to alert motorists of the limits of a roadway and of oncoming road hazards has been longstanding, and has been accentuated with the development of multi-lane high speed highways. In particular, the need to mark traffic lanes has long been appreciated, and various marking techniques have typically included strips of white paint, paint having retroreflective glass beads mixed therein, as well as raised pavement marker devices which are secured to the roadway at spaced intervals and which include a high efficiency reflector. All such devices suffer the disadvantage that they are not internally illuminated, i.e., that they only become visible when light from an oncoming vehicle is directed toward the device and is reflected therefrom; and thus in many situations do not adequately alert motorists approaching a hidden hazard such as a sudden left turn.

Internally illuminated marker devices to extend the region of visibility have also been previously suggested. For example, U.S. Pat. No. 3,836,275 (Finch) discloses a marking system in which a flexible molded strip of resilient material had disposed therein electrical conductors which may be utilized to power self-illuminating light sources inserted into recesses in the strip. A major limitation of this and other prior art self-illuminated devices is that the roadway must be cut away to allow installation of electrical lines. Generally, a source of electrical power such as conventional utility power lines must also be available nearby. The high cost of such installations has precluded the use of such devices in all except very high hazard areas such as airport runways.

Self-contained devices providing a flashing light to alert motorists of roadside hazards are commonplace, being typically provided with construction and road defect barricades. Such devices are generally intended for temporary use. Thus, while the incandescent light provided therein may be relatively bright, the battery life time is but a few months even though a fairly large battery pack is provided.

SUMMARY OF THE INVENTION

In contrast to such prior art traffic control devices in which external electrical power must be supplied via electrical leads embedded into the roadway, the internally illuminated control device of the present invention is totally self-contained. Furthermore, the device of the present invention differs from prior art battery powered devices in that the use of a flashing LED enables a readily visible light source to be permanently and inexpensively installed on surfaces where prior art devices could not be utilized, such as on road surfaces, while yet achieving a battery life which is commensurate with acceptable maintenance intervals.

The traffic control device of the present invention comprises a support member adapted to be secured to a surface whereat the device is visible to motorists to provide a warning of a hazard proximate the location of the device. The support member includes one side which allows light to pass therethrough. In one embodiment, the side itself may be relatively transparent, while in another embodiment, the side may be opaque and have openings through which the light may be transmitted.

A solid state light emitting device such as a light emitting diode (LED) is positioned within the support member such that light produced thereby emerges through the side of the support member adapted to pass light. The use of a LED is especially advantageous in that the high efficiency of such a device coupled with rapidity with which such sources may be switched on and off enables the LED to be operated in a pulsed mode, thereby extending the battery life. Also contained within the support member are a power supply, such as a rechargeable battery pack a solar cell for recharging the battery pack during periods of high ambient light intensity, and, a network for controlling the energization of the LED. The network includes an oscillator means such as a solid state R-C controlled circuit, which when activated periodically energizes the LED and light sensing means such as a photocell for activating the oscillator when the ambient light level is below a predetermined level. The combination of these respective components enables the device to be light actuated, i.e., to turn on when the ambient light level is below a predetermined threshold, thereby conserving battery life during periods when the device is not needed. Furthermore, the oscillator enables the LED to be driven intermittently, thereby further extending battery life. These features enable a relatively small battery pack to be included within the support member such that the device is small, compact and rugged while yet having appreciable intensity.

In one embodiment the traffic control device of the present invention is adapted for use as a traffic lane delineator and includes as the support member a housing adapted to be secured to a roadway surface and to be subjected to vehicle traffic. The housing is provided with a top and sloped sides supporting the top such that vehicles may readily pass thereover without damage to the housing. One of the sides is adapted to allow light to pass therethrough.

In another embodiment the device of the present invention is in the form of a thin flexible strip having a plurality of light emitting diodes positioned at spaced intervals along the strip with the light emitting portion of the device projecting through openings in the strip such that light produced by the device is primarily directed away from and normal to the strip. In this embodiment, an array of printed circuit conductors is sandwiched within the strip to connect each of the diodes to a sequencer circuit which enables sequential energization of the diodes to produce a train of flashes of light which apparently traverses the strip to thereby alert motorists to the presence of a traffic hazard. Such a device is particularly suited for installations in which the strip is mounted substantially horizontal such that the train of flashes of light may be utilized to instruct motorists to move in the direction of the apparent light traversal.

DESCRIPTION OF THE PREFERRED EMBODIMENT

Figure 1:
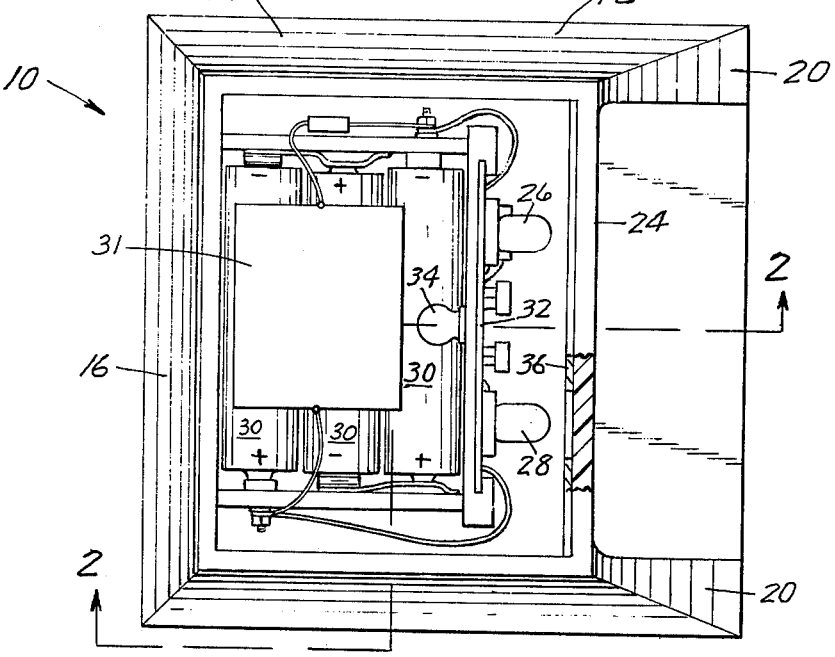
FIG. 1 is a partially cut-away top view of one embodiment of the present invention.
Figure 2:
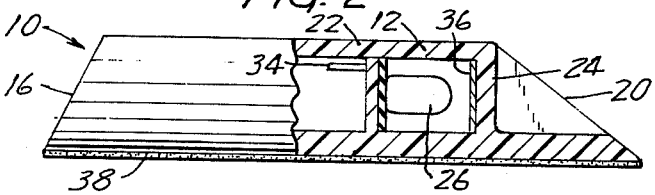
FIG. 2 is a partially cut-away side view of the embodiment shown in FIG. 1.
Figure 3:
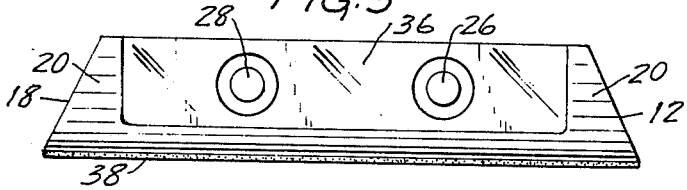
FIG. 3 is a front view of the embodiment shown in FIG. 1.

FIGS. 1-3 show one embodiment of the present invention particularly suited for use as a traffic lane delineator device. In these figures, the device 10 includes as a support member a housing 12 which may be fabricated of a variety of rigid materials, including metals and tough plastics such as polymethyl methacrylate and polycarbonate. The latter material may be preferred due to the low cost of such materials and the ease with which such a housing may then be molded. Furthermore, such materials may be obtained in a relatively transparent form such that light may be directed into and out of the housing without providing for separate openings, thereby lowering the cost of the device while also facilitating the sealing of the device against water, dirt and the like.

The housing 12 is provided with sloped sides 14, 16, 18 and 20, respectively, which support a top member 22. The sides and top members are made relatively rigid and are sloped such that vehicles may readily pass over the device without damage thereto. Side 20 is provided with a substantially vertical portion 24 which is adapted to allow light to pass therethrough. In the embodiment shown in FIGS. 1-3, the transparent portion is provided by forming the entire housing 12 of a transparent material such as polymethyl methacrylate such that the vertical portion 24 is entirely transparent. If the housing 12 is made of a metal or other nontransparent material, the portion 24 may be made with a window or otherwise fitted with a transparent material as desired. The housing 12 is further provided with a removable base portion (not shown) to facilitate insertion and/or removal of components positioned within the housing.

Positioned within the housing 12 are various components which are interconnected to provide a self-contained source of flashing light. These components include a light emitting diode, a power supply, and a network including an oscillator and a photocell for periodically activating the light emitting diode when the intensity of the ambient light is below a predetermined level. In FIG. 1, two light emitting diodes 26 and 28 are provided and are driven in parallel to ensure that the output luminous light intensity of the device 10 exceeds a minimum level of 160 millicandela. The device further includes a battery pack 30 which comprises three type AA rechargeable batteries inserted in series to provide a total voltage of approximately 4.5 volts and a solar cell 31. The light emitting diodes 26 and 28 are mounted on printed circuit board 32 together with the network for intermittently connecting the power supply 30 to the diodes 26 and 28. Also mounted on the printed circuit board 32 is a photocell 34. In a preferred embodiment, a sheet of retroreflective material such as Scotchlight Brand Reflective Sheeting, manufactured by Minnesota Mining and Manufacturing Company, may be provided on the inside of the vertical portion 24 and provided with appropriate holes such that light produced by the diodes 26 and 28 may be projected therethrough.

In a preferred embodiment, the housing 12 is further provided with a layer of adhesive 38 on the base of the housing to facilitate the attachment of the housing to a pavement surface. Such an adhesive may conveniently be provided with a release liner (not shown) which may be removed prior to application of the device to a roadway surface.

Figure 4:
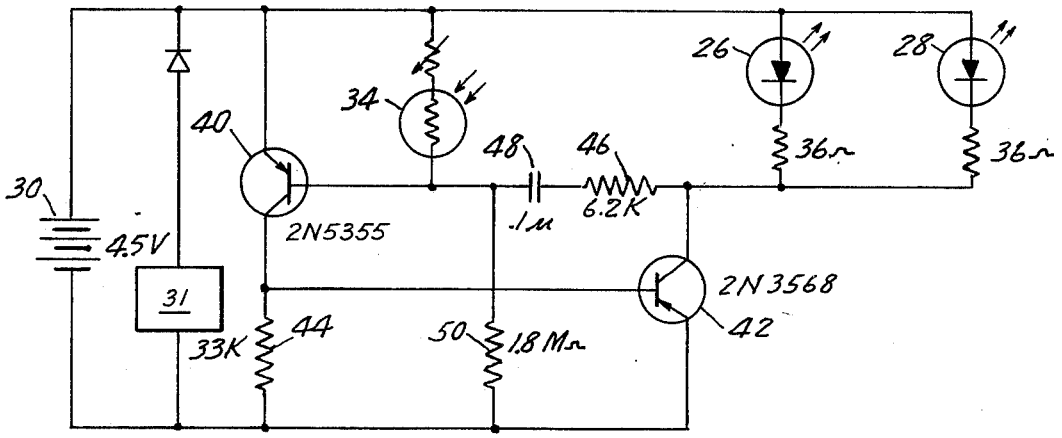
FIG. 4 is a schematic diagram of a circuit preferably used in the embodiment shown in FIGS. 1-3.

Details of a circuit preferably used in the embodiment shown in FIGS. 1-3 are set forth in FIG. 4. As is there set forth, the network for coupling the electrical power from the battery 30 to the light emitting diodes 26 and 28 comprises a solid state oscillator including transistors 40 and 42, together with the resistor 44 and the resistor-capacitor combination 46 and 48, the latter of which dictate the oscillation rate of the oscillator. The photocell 34 is connected in series with a resistor 50 across the battery 30 such that when the ambient light intensity is relatively high, i.e., when sunlight is shining on the device, the potential at the base of transistor 40 is approximately the same as that at the emitter of the transistor such that transistor is turned off and substantially the full voltage drop across the battery flows through the resistor 50. Since this resistor is of a high value, i.e., approximately 1.8 MΩ, no appreciable current flow occurs and a long battery life is ensured. When the ambient light intensity is relatively low, the potential on the base of transistor 40 is also lowered such that transistor 40 conducts. This in turn allows the potential on the base of transistor 42 to rise, thereby turning on transistor 42 such that current flows through the light emitting diodes 26 and 28 causing them to emit. At this time, charge builds up across the capacitor 48 ultimately causing transistor 40 and 42 to turn off. Upon decay of the charge on capacitor 48, transistor 40 will again turn on, thereby reinitiating the oscillation. Using components as depicted in FIG. 4, a rate of oscillation of approximately 10 cps is obtained, thereby achieving an operation in which the light emitting diodes 26 and 28 are on for approximately 2 milliseconds and off for a period of approximately 100 milliseconds.

Figure 5:
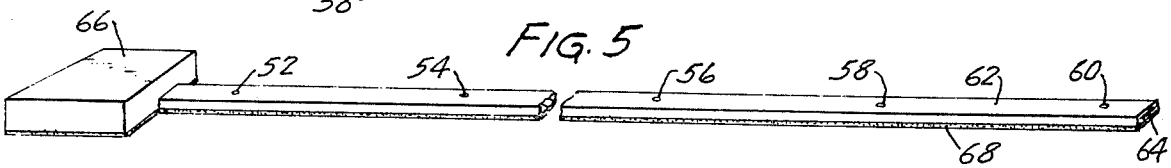
FIG. 5 is a perspective view of another embodiment of the present invention.
Figure 7:
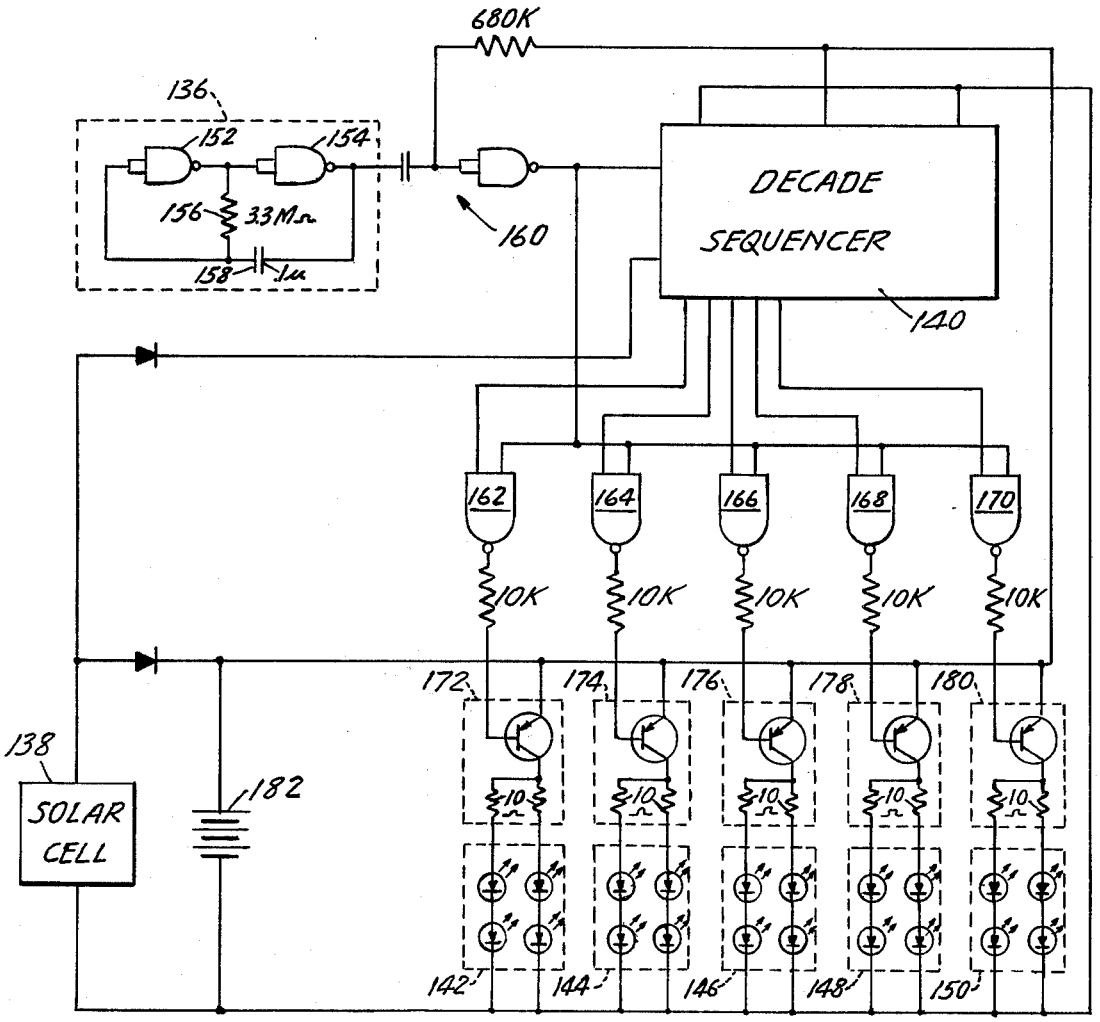
FIG. 7 is a schematic diagram of a circuit preferably used in the embodiment shown in FIGS. 5 and 6.

FIG. 5 shows another embodiment of the present invention in which an array of light emitting diodes 52, 54, 56, 58 and 60 are positioned at spaced intervals along a flexible strip 62. Laminated within the strip 62 is a flexible printed circuit board 64 containing electrical connections to each of the light emitting diodes. The printed circuit board is coupled into the housing 66 within which (not shown) are contained the battery pack and associated electronic components for energizing the light emitting diodes. A particularly desirable circuit for energizing the diodes is shown in FIG. 7. The flexible strip 62 is preferably made of a resilient material such as a polymeric foam and is desirably provided with a retroreflective material on the top surface, such as a retroreflective sheet, retroreflective paint or the like, and with an adhesive layer 68 on the bottom of the strip 62, thereby facilitating the attachment of the device to roadside barricades, posts and the like.

Figure 6:
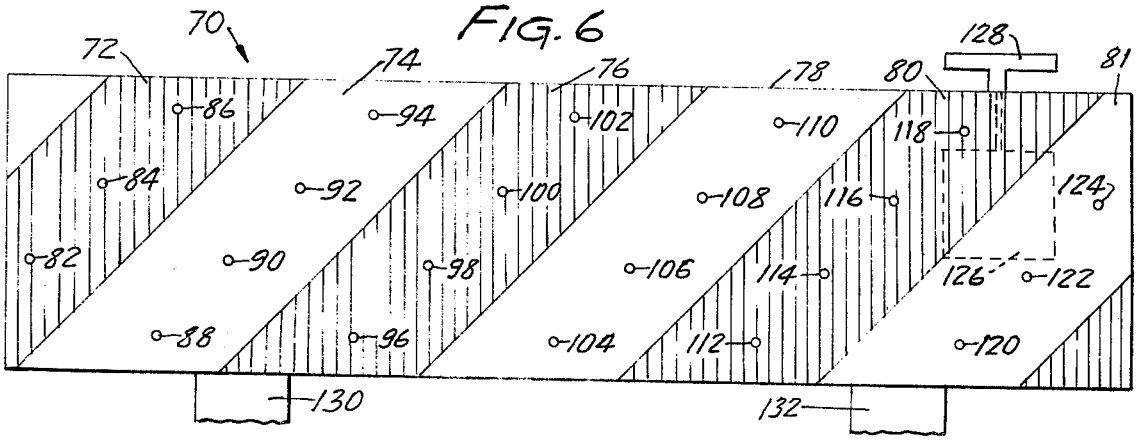
FIG. 6 is a front view of a different embodiment of the present invention.

FIG. 6 shows another embodiment similar to that shown in FIG. 5. In this embodiment, the array of light emitting diodes includes a number of sets of light emitting diodes, each set of which contains a number of light emitting diodes connected such that all of the diodes within a given set are simultaneously energized. The device 70 includes a plurality of diagonal bands 72, 74, 76, 78, 80 and 81 of alternating colors such as is conventionally provided on roadway barricades. Within the band 72, three light emitting diodes 82, 84 and 86 make up the first set of diodes. Similarly, within the band 74, diodes 88, 90, 92 and 94 make up the second set. In like manner, the third set within the band 76 comprises the diodes 96, 98, 100 and 102; the fourth set within the band 78 comprises the diodes 104, 106, 108 and 110; the fifth set within the band 80 comprises the diodes 112, 114, 116 and 118; and the sixth set within the band 81 comprises the diodes 120, 122 and 124. The diodes within each set are interconnected and individual leads are provided to each set such that the diodes within a given set may be energized separately from the diodes in the remaining sets. The electrical leads from each of the sets are coupled into a housing 126 within which are positioned the associated components for driving the diodes. Also provided within device 70 is a solar cell array 128 such that solar energy may be utilized to recharge a battery pack within the housing 126. The device 70 may typically be supported on posts 130 and 132 in a conventional manner.

A preferred circuit for sequentially energizing the arrays of light emitting diodes in the embodiments shown in FIGS. 5 and 6 is set forth in FIG. 7. This circuit includes a network comprising an oscillator 136, a solar cell 138, which also functions as a light sensor, and an integrated circuit decade sequencer 140 such as Type CD 4017, manufactured by RCA, Inc., for sequentially energizing the sets of light emitting diodes 142, 144, 146, 148 and 150. The oscillator 136 comprises a pair of conventional CMOS NAND gates 152 and 154 together with an associated resistor-capacitor 156 and 158 which thereby provides an oscillator rate of 3 cps. The output of the oscillator 136 is coupled through a pulse generator 160 including NAND gate and an associated RC network which provides a 20 msec pulse to the decade sequencer 140 to activate the sequencer during the "on" periods. Outputs from the decade sequencer 140 are coupled through NAND gates 162, 164, 166, 168 and 170 to lamp driving circuits 172, 174, 176, 178 and 180. The outputs of the lamp driving circuits drive the respective sets of light emitting diodes 142, 144, 146, 148 and 150. Also provided as inputs to the NAND gates 162, 164, 166, 168 and 170 is an output from the oscillator 136 through the pulse generator 160 so as to enable activation of a given lamp driving circuit only during the periods when the pulse is in an "on" state. In this embodiment, the power is provided via a secondary battery 82 which is recharged via the solar cell 138. A particularly desirable solar cell, such as Type S 222, manufactured by Sharp Electronics, also functions as a photocell and provides a reset signal to the decade sequencer 140 during periods when the intensity of the ambient light is below a predetermined level. While in this embodiment an array of 5 sequentially energized sets of light emitting diodes is disclosed, it is within the scope of the invention that as many diodes as are described for a given application may be similarly energized.

Having thus described the present invention, what is claimed is:

1. A traffic control device comprising a. a support member adapted to be secured to a surface whereat the device is visible to motorists to provide a warning and including one side which allows light to pass therethrough, b. a light emitting diode positioned within the support member such that light produced thereby emerges through said one side, c. a power supply positioned within the support member including a rechargeable battery pack for energizing said light emitting diode and a solar cell for recharging the battery pack during periods of high ambient light intensity, whereby the device is totally self-contained, and d. a network positioned within the support member for controlling the coupling of electrical power from the power supply to said light emitting diode, including oscillator means which when activated periodically couples power to energize said light emitting diode and light sensing means for activating the oscillator means when the intensity of the ambient light is below a predetermined level, whereby the use of said periodically energized light emitting diode enables the device to be small, compact and rugged while yet having appreciable intensity and practical battery life enabling acceptable maintenance intervals.

2. A device according to claim 1, wherein a retroreflective material is disposed adjacent said one side for enhancing the visibility of the device during periods when said light emitting diode is not energized.

3. A device according to claim 1, wherein said network comprises a solid state circuit including a photocell and a transistorized oscillator.

4. A device according to claim 1, wherein the support member includes a housing adapted to be secured to a roadway surface and to be subjected to vehicle traffic thereon, said housing comprising a base, a rigid top and sloped sides supporting the top facilitating the passage of vehicles thereover without damage to the housing.

5. A device according to claim 4, further comprising pressure sensitive adhesive means on the bottom of the base for securing the housing to the surface of a roadway.

6. A device according to claim 1, further comprising adhesive means for securing the support member to a said surface.

7. A device according to claim 1, wherein said support member includes an elongated flexible strip having one side containing a plurality of openings at spaced intervals, and wherein the device further comprises an array of light emitting diodes positioned within the strip with the light emitting portion thereof projecting through the openings in the strip such that light produced by the diodes is primarily directed away from and normal to the strip, an array of printed circuit conductors sandwiched within the strip providing separate electrical contacts to each light emitting diode of the diode array, and a sequencer circuit within the network for sequentially energizing preselected diodes of the diode array for producing a train of flashes of light which apparently traverse the strip to thereby alert motorists to the presence of a traffic hazard.

8. A device according to claim 7, further comprising a layer of pressure sensitive adhesive adjacent a surface of the strip opposite that through which the diodes project for facilitating the application of the device to posts, barricades and the like.

9. A device according to claim 7, further comprising a layer of retroreflective material secured to the surface of the strip through which the diodes project and having openings through which light from the diodes may be transmitted.

10. A traffic lane delineator device comprising a housing adapted to be secured to a roadway surface and subjected to vehicle traffic thereon comprising a base, a rigid top and sloped sides supporting the top facilitating the passage of vehicles thereover without damage to the housing, wherein one of said sides is adapted to allow light to pass therethrough, a light emitting diode positioned within the housing such that light produced thereby emerges through said one side, a power supply including a rechargeable battery pack and a solar cell for recharging the battery pack during periods of high ambient light intensity positioned with the housing, a network positioned within said housing for controlling the energization of the light emitting diode, including oscillator means which when activated periodically energizes the light emitting diode and light sensing means for activating the oscillator means when the intensity of the ambient light is below a predetermined level, and a retroreflective material disposed adjacent said one side for enhancing the visibility of the delineator device during periods when the network is de-energized, whereby the use of the periodically energized light emitting diode enables the delineator device to be small, compact and rugged, usable directly on traffic surfaces while yet having appreciable intensity and practical battery life enabling acceptable maintenance intervals.

11. A traffic hazard warning device comprising a. a thin layer of a flexible material having a high degree of conformability, b. an array of light emitting diodes mounted within the layer at spaced intervals with the light emitting portion thereof projecting through the layer such that light produced thereby is primarily directed away from and normal to the layer, c. an array of printed circuit conductors sandwiched within the layer providing separate electrical contacts to each light emitting diode within the diode array, and d. means within said device for sequentially energizing adjacent diodes of the diode array for producing a train of flashes of light which apparently traverses the device, said means for sequentially energizing comprising a rechargeable battery pack, means such as a solar cell for generating electrical power during periods of high ambient light intensity to recharge said rechargeable battery pack and a network for controlling the coupling of electrical power from the battery pack to the diode array including oscillator means which when activated periodically couples power to energize the diode array and light sensing means for activating the oscillator means when the intensity of the ambient light is below a predetermined level, such that motorists may be alerted to the presence of a traffic hazard and instructed to move in a desired direction.

12. A device according to claim 11, further comprising a layer of pressure sensitive adhesive adjacent the flexible layer for facilitating the application of the device to posts, barricades and the like.

13. A device according to claim 11, further comprising a layer of retroreflective material secured to that surface of the flexible layer through which the diode array projects and having openings through which the light from the diode array may be transmitted.

14. A device according to claim 11, wherein said means for sequentially energizing further comprises an integrated circuit decade sequencer having at least as many outputs as there are light emitting diodes in said diode array and associated logic gates for driving each diode in sequence when also triggered by said oscillator means.

* * * * *

UNITED STATES PATENT AND TRADEMARK OFFICE

CERTIFICATE OF CORRECTION

PATENT NO. : 4,050,834

DATED : September 27, 1977

INVENTOR(S) : John H. Lee

It is certified that error appears in the above-identified patent and that said Letters Patent are hereby corrected as shown below:

Column 5, line 51, change "82" to -- 182 --.

Signed and Sealed this

*Twenty-eighth* Day of *March 1978*

[SEAL]

*Attest:*

RUTH C. MASON
*Attesting Officer*

LUTRELLE F. PARKER
*Acting Commissioner of Patents and Trademarks*